US005707273A

United States Patent [19]

Grivna

[11] Patent Number: 5,707,273

[45] Date of Patent: Jan. 13, 1998

[54] MULTIPLE-PAD ORBITAL SANDER WITH SPLIT PAD PLATEN

[75] Inventor: Howard W. Grivna, Maple Grove, Minn.

[73] Assignee: Timesavers, Inc., Minneapolis, Minn.

[21] Appl. No.: 615,055

[22] Filed: Mar. 13, 1996

Related U.S. Application Data

[63] Continuation of Ser. No. 234,659, Apr. 28, 1994, abandoned.

[51] Int. Cl.[6] ..... B24B 7/06; B24B 7/12; B24B 55/06

[52] U.S. Cl. ..... 451/163; 451/167; 451/164; 451/453; 451/456

[58] Field of Search ..... 451/166, 167, 451/164, 172, 162, 344, 356, 357, 351, 453, 456, 163

[56] References Cited

U.S. PATENT DOCUMENTS

| | | |
|---|---|---|
| Re. 29,247 | 6/1977 | Kilstrom et al. . |
| 135,535 | 2/1873 | Finn . |
| 1,286,697 | 12/1918 | Manofsky . |
| 1,876,328 | 9/1932 | Loetscher . |
| 1,921,995 | 8/1933 | Solem . |
| 1,962,765 | 6/1934 | Crowley et al. . |
| 1,962,766 | 6/1934 | Crowley . |
| 1,962,767 | 6/1934 | Crowley et al. . |
| 2,548,979 | 4/1951 | Johnson . |
| 2,621,445 | 12/1952 | Wallace . |
| 3,094,815 | 6/1963 | Pendergast . |
| 3,178,860 | 4/1965 | Clyne . |
| 3,416,261 | 12/1968 | Sherman et al. . |
| 3,734,700 | 5/1973 | Gutierrez et al. . |
| 3,889,429 | 6/1975 | Zuercher . |
| 4,328,645 | 5/1982 | Sauer . |
| 4,381,628 | 5/1983 | Dicke . |
| 4,660,329 | 4/1987 | Hutchins . |
| 4,733,500 | 3/1988 | David . |
| 4,837,984 | 6/1989 | David . |
| 4,864,775 | 9/1989 | David . |
| 5,081,794 | 1/1992 | Haney . |
| 5,181,342 | 1/1993 | Haney . |
| 5,321,913 | 6/1994 | Haney . |
| 5,443,414 | 8/1995 | Haney . |

*Primary Examiner*—Timothy V. Eley
*Attorney, Agent, or Firm*—Haugen and Nikolai, PA

[57] ABSTRACT

An abrasive, sanding and/or surface finishing apparatus designed to extend the useful life of abrasive material which employs a dual-platen arrangement having a particulate removal system designed to effectively remove particulate from the working area of the machine. Specifically, the particulate removal system is designed to remove particles from the surface of the work in the area of the gap created between the twin platens, with a secondary particulate removal system designed to remove material from the work following treatment by abrasive from both platens. The inlet port of the particulate removal system interposed between the platens is designed to occupy a substantial portion of the area within the gap zone between the platens. In addition to increasing the useful life of the abrasive, the particulate removal system reduces the release or discharge of dust into the ambient.

6 Claims, 5 Drawing Sheets

MULTIPLE-PAD ORBITAL SANDER WITH SPLIT PAD PLATEN

This is a Continuation of application Ser. No. 08/234,659, filed on Apr. 28, 1994 now abandoned.

BACKGROUND OF THE INVENTION

The present invention relates generally to an improved sanding, abrasive, and/or surface finishing apparatus, and particularly for a sanding apparatus which is arranged to provide extended life for abrasive material, such as sandpaper or emery cloth, and also reduce the quantity of particulate material and/or dust which is released into the ambient during operation. The apparatus of the present invention is also designed to provide improved versatility and economy in operation, while maintaining a high quality finish on the surfaces of workpieces being treated.

In the past, various abrasive surface finishing apparatus have been utilized which incorporate a platen which is adapted to be moved and create relative motion for moving abrasive materials across the surface of workpieces. One such device which employs a conveyor with a pair of tandemly arranged cross-belts moving cover an orbiting platen is disclosed in U.S. Pat. Nos. 4,733,500 and 4,837,984 to David, each of which patents is assigned to the assignee of the present invention. While these orbital platens provide motion to the moving belt, the useful life of the belt may be extended when the abrasive surfaces of the belts are maintained free of accumulated particulate material. Moving platens mounted over a conveyor are disclosed in U. S. Pat. Nos. 5,081,794 and 5,181,342 to Haney. In these patents, however, the device as disclosed employs a single or unitary operating head or platen. While multiple platens or heads are illustrated in Sherman et al U.S. Pat. No. 3,416,261, the platens are operated without the benefit of a particulate removal means disposed in a gap between a twin platen system, it being understood that the invention is applicable to various multiple-pad arrangements as described hereinafter.

In the utilization of abrasive sheets, particularly in a system employing wide platens, the downstream portion of the abrasive tends to become loaded with particulate well prior to the upstream portion. Therefore, there has been little, if any, impetus toward the utilization of wide platens, since the increasing width tends to decrease the expected and/or useful lifetime of abrasive due to particulate loading on the downstream or trailing edge portions. Particulate loading impedes the ability of the abrasive to effectively function on the work, thereby reducing the working width of the abrasive on the platen, and correspondingly degrading the ability of the abrasive. In addition to reducing the effectiveness and the efficiency of the abrasive, particulate build-up may also adversely affect the ability of the machine to maintain dimensional uniformity in the thickness of the work, thereby adversely affecting the quality of the output from a given machine. In order to reduce the affect of particulate build-up, the present invention employs a multiple platen arrangement such as a twin platen arrangement wherein a gap is interposed between the opposed sides of a twin platen arrangement, and this gap is selected for the introduction and positioning of the vacuum inlet port of a particulate removal system. In a twin platen arrangement, the port is preferably positioned in close proximity to the downstream side of the upstream platen, and also in close proximity to the surface of the work. This arrangement has been found to achieve substantially complete removal of loose particulate from the surface of the work and from the downstream portion of the abrasive. It has been found that removal of particulate from those locations in the apparatus effectively reduces the tendency of downstream build-up, thereby increasing the lifetime of the abrasive, while at the same time, enhancing the ability of the apparatus to maintain performance and dimensional uniformity of the work.

In the arrangement described hereinafter, particular attention is directed to a twin platen arrangement, and it will be understood that the features of the present invention are applicable to systems employing multiple platens, including arrangements with more than two platens. In these instances, each of the platens will be spaced apart from its neighbor so as to provide inter-platen gaps, and wherein the number of gaps is equivalent to the number of platens minus one. The advantages of the invention may be achieved in multiple platen arrangements, wherein the arrangements include common drives and the like.

SUMMARY OF THE INVENTION

In accordance with the present invention, therefore, a surface treating apparatus employing spaced-apart twin platens and which employs an improved particulate removal means has been developed. One inlet of the particulate removal system is disposed in the gap zone created between the opposed side edge surfaces of the twin platens. This particulate removal system is designed to remove particulate directly from this gap zone, thereby reducing the tendency of particulate loading of the abrasive material, particularly in the downstream side of the abrasive. In order to achieve maximum benefits from the objectives of the present invention, the inlet port to the particulate removal system is designed to occupy a substantial portion of the area within the gap zone defined by opposed side edge surfaces of the twin platens. Also, the utilization of twin platens, while increasing the anticipated or useful life of the abrasive, also makes it possible to employ tandemly arranged abrasives of different grit size, with a coarse material typically being utilized for the upstream platen, and a relatively finer grit for surface finishing typically being utilized for the downstream platen.

Therefore, it is a primary object of the present invention to provide an improved surface treating apparatus arranged to provide extended life for abrasive material, and wherein the apparatus employs a twin platen arrangement with one inlet port of a particulate removal system being positioned in and occupying the gap area or zone between the twin platens.

It is yet a further object of the present invention to provide a twin platen arrangement for a surfacing or sanding apparatus which employs a conveyor for transporting the work to a work station in which there is positioned a twin platen arrangement, and wherein the platens are designed to move an abrasive such as sandpaper, emery cloth, or the like, and wherein the platens, as has been practiced in the art for an extended period, function either as pads to receive sheets or other forms of abrasive material, or as guides for the path of travel of an abrasive belt such as a cross-belt designed to move along an axial direction transverse to the axial direction of motion of the conveyor.

Other and further objects of the present invention will become apparent to those skilled in the art upon a study of the following specification, appended claims, and accompanying drawings.

IN THE DRAWINGS

FIG. 1 is a front elevational view of a sanding apparatus prepared in accordance with the present invention, with FIG.

1 showing the infeed end of one embodiment of the invention, and with certain portions of the framework of the structure being illustrated in section;

DESCRIPTION OF THE PREFERRED EMBODIMENT

Figure 1:
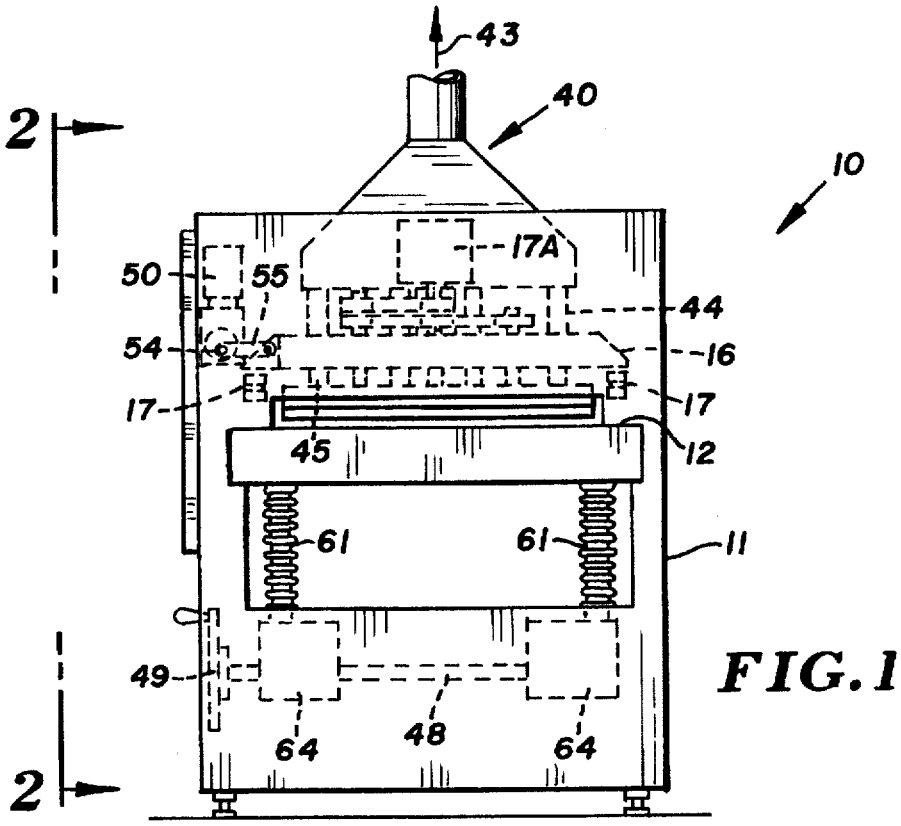
Figure 2:
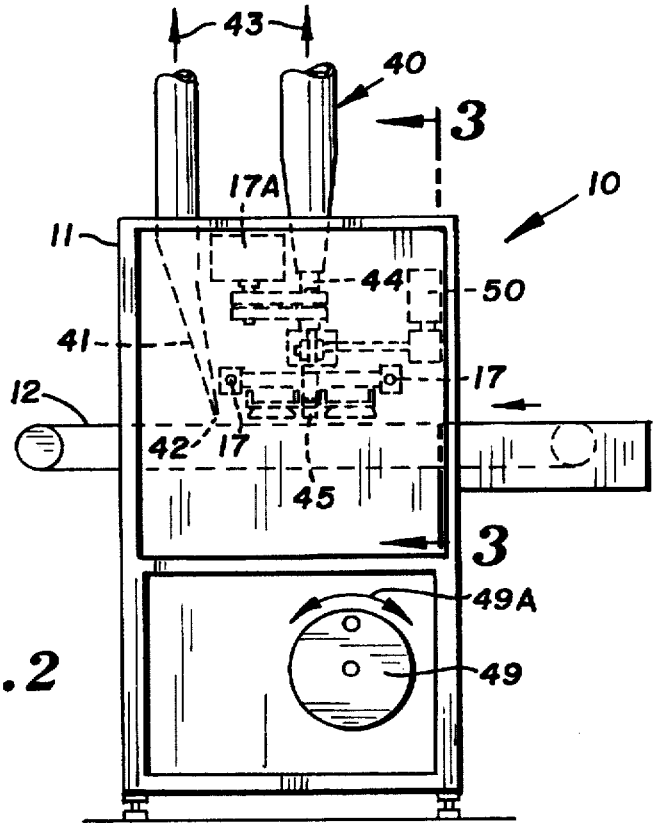
FIG. 2 is a side elevational view of the apparatus illustrated in FIG. 1, with FIG. 2 being taken along the line and in the direction of the arrows 2—2 of FIG. 1.
Figure 8:
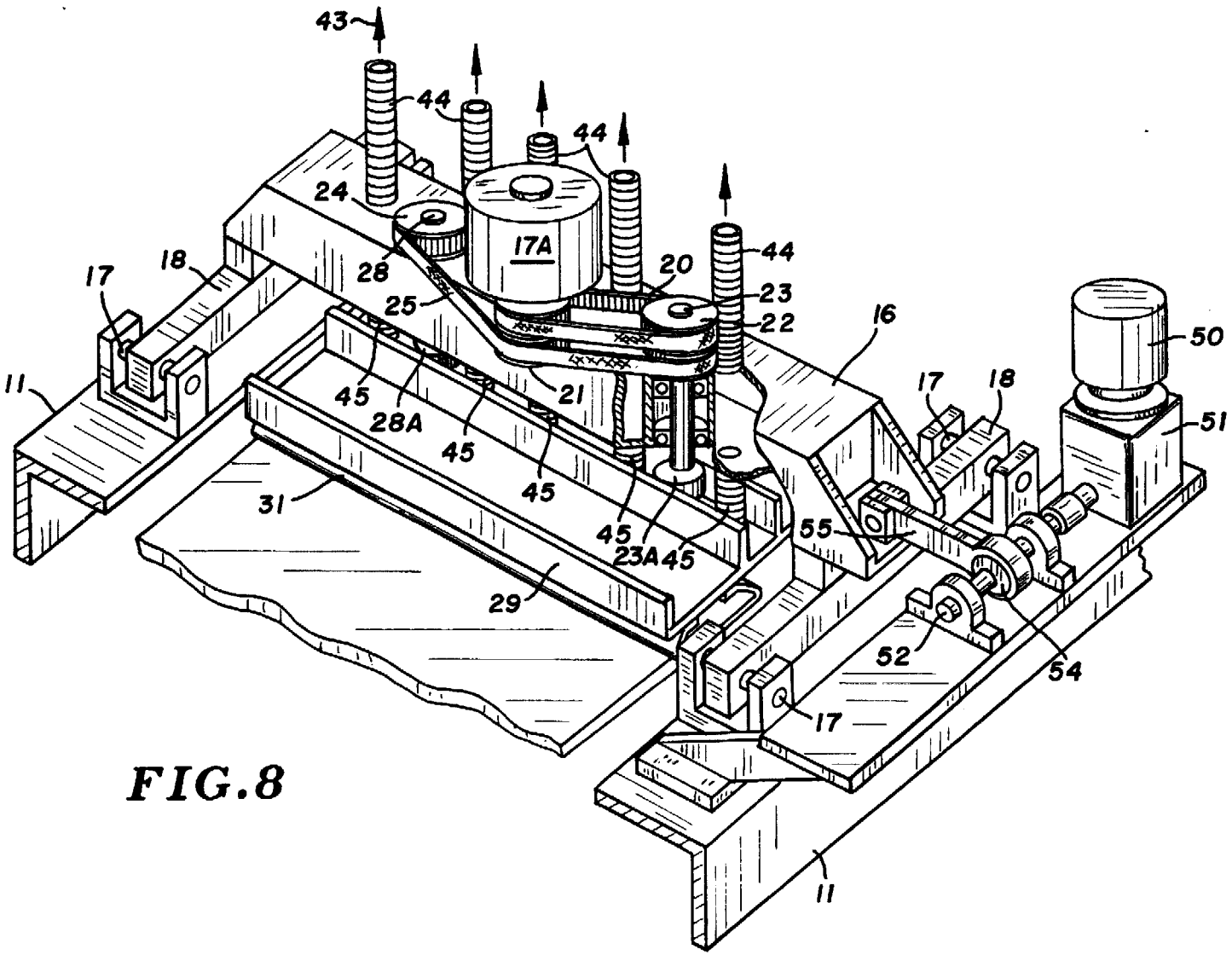
FIG. 8 is a fragmentary perspective view with portions being cut away, and illustrating the major features of the operating head component of the overall system.

In accordance with the preferred embodiment of the present invention and with particular attention being directed to FIGS. 1 and 2 of the drawings, the abrasive surface treating apparatus generally designated 10 comprises a main frame structure 11, preferably in the form of a rigid support structure, such as a weldment, for supporting a work carrying conveyor which includes an endless belt having a work supporting flight for transporting and retaining workpieces thereupon. The conveyor comprises a wide endless conveyor belt 12 which is guided about a predetermined path relative to the frame in order to form the endless belt conveyor. The conveyor belt 12 is a typical endless belt having a surface designed to support, retain, carry, and transport workpieces therealong while being treated by the apparatus of the present invention. Such belts are, of course, in common use and are commercially available. The abrasive surface treating apparatus 10 further includes a platen support member generally designated 16, with the assembly 16 being supported on frame 11 by means of individual support pins such as illustrated at 17—17. Assembly 16 may be designated a support beam assembly, and includes a motor 17A secured to assembly 16 by brackets such as bracket 18. As illustrated in detail in FIG. 8, primary drive belt 20 is trained about one sheave of motor pulley 21 and is further trained over driven pulley 22 coupled to shaft 23, with shaft 23 driving cam or eccentric 23A. A second pulley such as shown at 24 is utilized to accommodate secondary drive belt 25 which is, in turn, coupled to pulleys 21 and 22 for maintaining consistent timing while rotating shaft 28, with shaft 28 driving cam or eccentric 28A. In order to keep appropriate tension in belt 25, motor 17A is provided with an appropriate slotted mounting base so as to accommodate outward movement of motor 17A in order to tension both belts 20 and 25. In adjustably positioning motor 17A, the movement of motor 17A is undertaken so as to preserve the equality of distance between the motor shaft and each of shafts 23 and 28. By preserving the equality of this spacing, the timing for the coincidental movement of shafts 23 and 28 is likewise preserved. The support assembly 16 further includes multi-channel platen drive/mount member 29 to which platens such as illustrated at 30 and 31 are mounted. Each of platens 30 and 31 are arranged to retain abrasive, with the abrasive typically being secured to the platen by any of the conventional and well known techniques such as mounting with pressure sensitive adhesive or with spring-biased clips. As is apparent from the views of FIGS. 6 and 8, the platens 30 and 31 are mounted for ease of removal with respect to platen support member 16, with removal being accomplished by slidably removing platens laterally outwardly from the assembly.

In certain instances, it is desirable to provide precise level adjustment of platens 30 and 31 with respect to each other. For example, in certain applications of the device, it may be desirable to position the downstream platen at a slightly lower elevation than the upstream platen. For these situations, a plurality of accurately formed shims are provided, such as is illustrated at 30A and 30B and 31A, 31B and 31C in FIG. 6.

As an alternative, an abrasive cross-belt system may be utilized with twin or dual spaced-apart orbital platens, such as are illustrated in U.S. Pat. No. 4,733,500 to David described hereinabove, with the disclosure being incorporated by reference.

In order to provide appropriate counter-balance for the orbital drive portion of the system, counter-weights illustrated at 34—34 may be employed, with the use of such counter-weights being, of course, well known in the art. Cam bearings are typically utilized to couple shafts 23 and 23A and their rotational motion to the platens, and thereby convert rotational motion to orbital motion.

Figure 3:
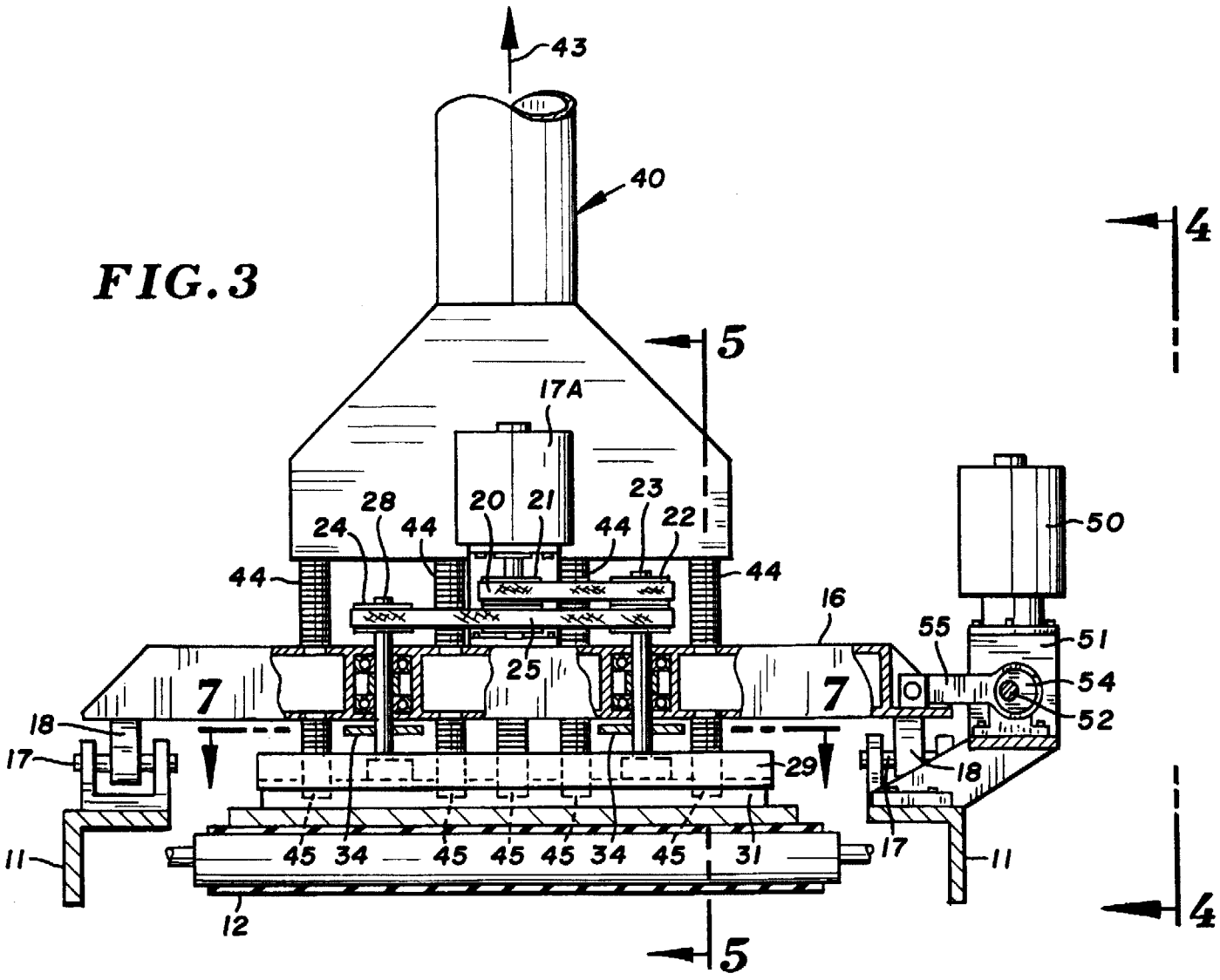
FIG. 3 is a detail front elevational view of the platen and platen drive arrangement of one embodiment of the present invention, with FIG. 3 further illustrating the manner in which the dust and/or loose particulate is removed from the surface of the work and from the apparatus, with FIG. 3 being taken along the line and in direction of the arrows 3—3 of FIG. 2.
Figure 4:
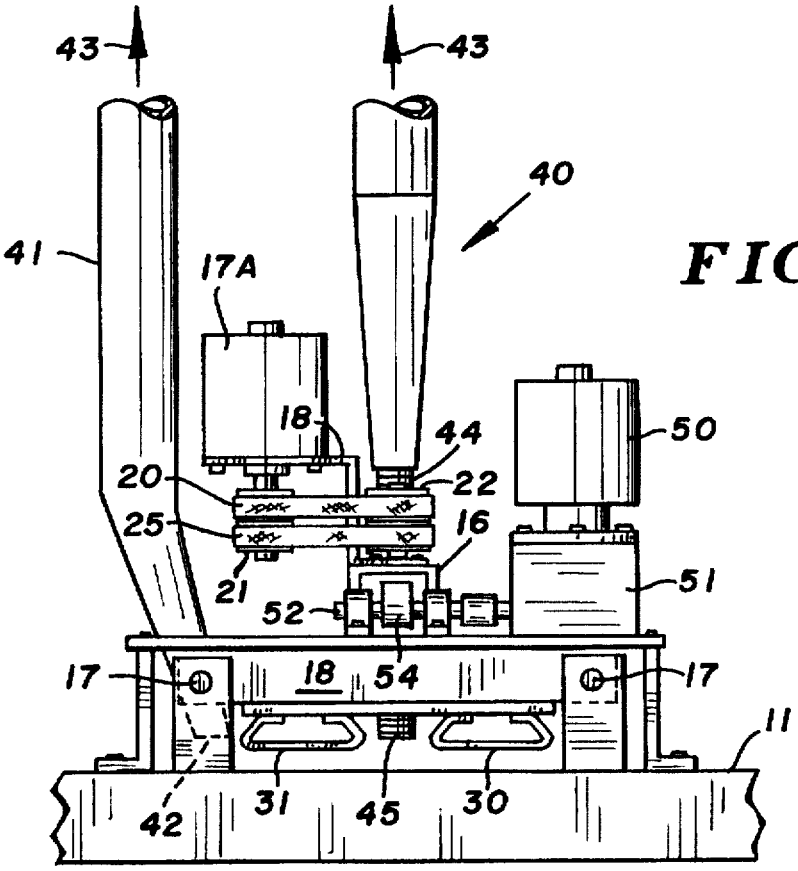
FIG. 4 is a detail end elevational view of the platen drive arrangement illustrated in FIG. 3.

Continued attention is directed to FIGS. 3 and 4 of the drawings wherein the particulate removing hood assembly is shown generally at 40. Hood 40 includes an inlet porting arrangement at the base, and with the inlet porting arrangement being located within the gap between twin platens 30 and 31. The twin platens are shown in greater detail in FIGS. 4 through 7. The twin platens each employ separate abrasive, and either the same abrasive or abrasive of different coarseness and/or fineness may be employed.

The dust hood 40 has a chamber with ports defined as a plurality of inlets as at 45—45, as shown in detail in FIGS. 3 and 4. As is apparent, inlets 45 occupy a substantial portion of the zone created between the opposed surfaces of the twin platens 30 and 31.

Dust hood 40 is provided with a second inlet for particulate removal, such as at 41. Inlet 41 may be provided as a conveyor belt-wide port such as shown at 42. The vacuum created within the system causes the flow of particulate entrained air along the line and in the direction of the arrows 43—43. In this arrangement, therefore, the individual ports as shown at 45—45 will remove and/or clean the work surface in the gap zone between the platens 30 and 31, with the trailing particulate removal system 41 being utilized to remove particulate from the surface of the work following its exit from the trailing platen of the twin platen arrangement.

Figure 5:
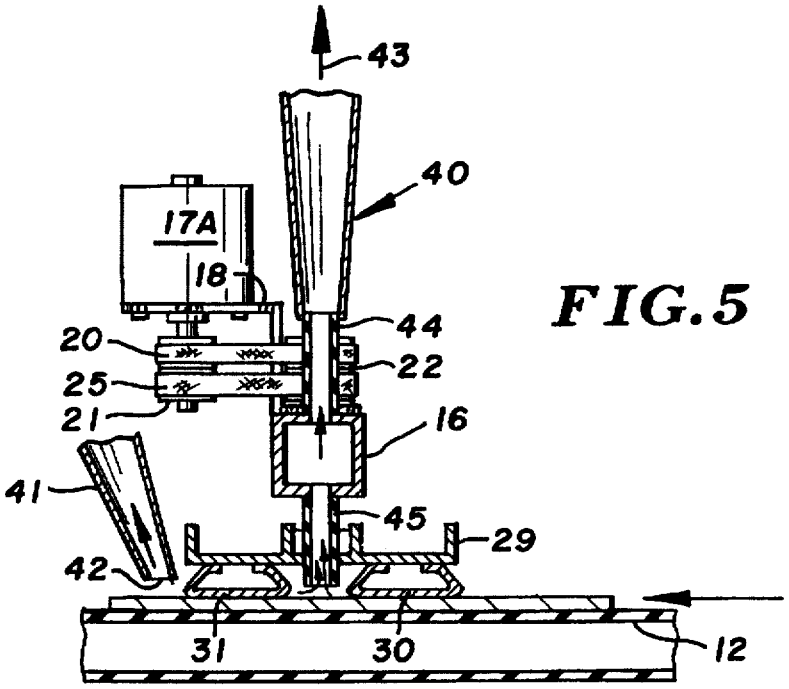
FIG. 5 is a detail fragmentary view, partly in section, and illustrating the work station including the twin platen arrangement and the particulate removal system, and also illustrating a fragmentary portion of the work supporting conveyor.

With continued attention being directed to FIGS. 1, 3 and 5 of the drawings, it will be noted that platen support member 16 functions as a plenum or elongated chamber for the dust removal system 40. Individual flexible conduits such as shown at 44—44 are utilized to accommodate the relative motion between platen support member 16 and hood member 40. Additionally, the chamber within support member 16 may provide a buffer storage zone for a certain amount of particulate material traveling and/or moving between the surface of the workpiece and the particulate collection filter being utilized, as is typical, downstream in the dust collection assembly which includes the hood arrangement 40.

In order to accommodate workpieces of different dimensions within the working station established between the surface of the abrasive heads and the surface of the conveyor belt 12, the conveyor mechanism may be controllably raised and lowered by means of screws, jacks or jack-shafts 48—48, the axial disposition of which are ultimately controlled by crank wheel 49. In other words, rotation of the crank wheel 49 in the direction of the double-headed arrow 49A will raise and/or lower the plane of the upper flight of conveyor belt 12 to control the thickness of the working station. Such an arrangement is, of course, conventional and well known in the art. Gear boxes are typically provided for imparting and delivering axial motion to the individual screw shafts 61—61, preferably with the use of conventional drive chain or the like.

In operation, therefore, the individual heads are coupled together to provide simultaneous orbital motion, with reciprocatory motion for the system being created by motor 50 and its associated components. Specifically, the output shaft of motor 50 enters gearbox 51 which drives eccentric-carrying shaft 52, with eccentric 54 thereon operating connecting crank 55. Crank 55 is designed to reciprocate support member 16 in a to-and-fro motion, thereby creating an additional component of motion to the abrasive.

In operation, therefore, motor 17A is started and platens 30 and 31 are caused to move in an orbital path. With motor 50 in operation, support member 16 reciprocates across the working zone in a direction transverse to the axis or machine direction of endless belt 12 of conveyor 11. In order to eliminate particulate from the work, and accordingly reduce particulate build-up on the abrasive, dust hood and/or ductwork 40 along with its inlet ports 45—45 carries particulate through the system and along through outlet port at the other end. Separator/collector means such as filters and/or bag housing arrangements may be employed in order to collect particulate, with such filters and bag house design being, of course, well known in the art. The positioning of the inlet port within the gap zone in close proximity to the surface of the work for direct removal of particulate from the work has been found to enhance the overall operation of the system.

Figure 6:
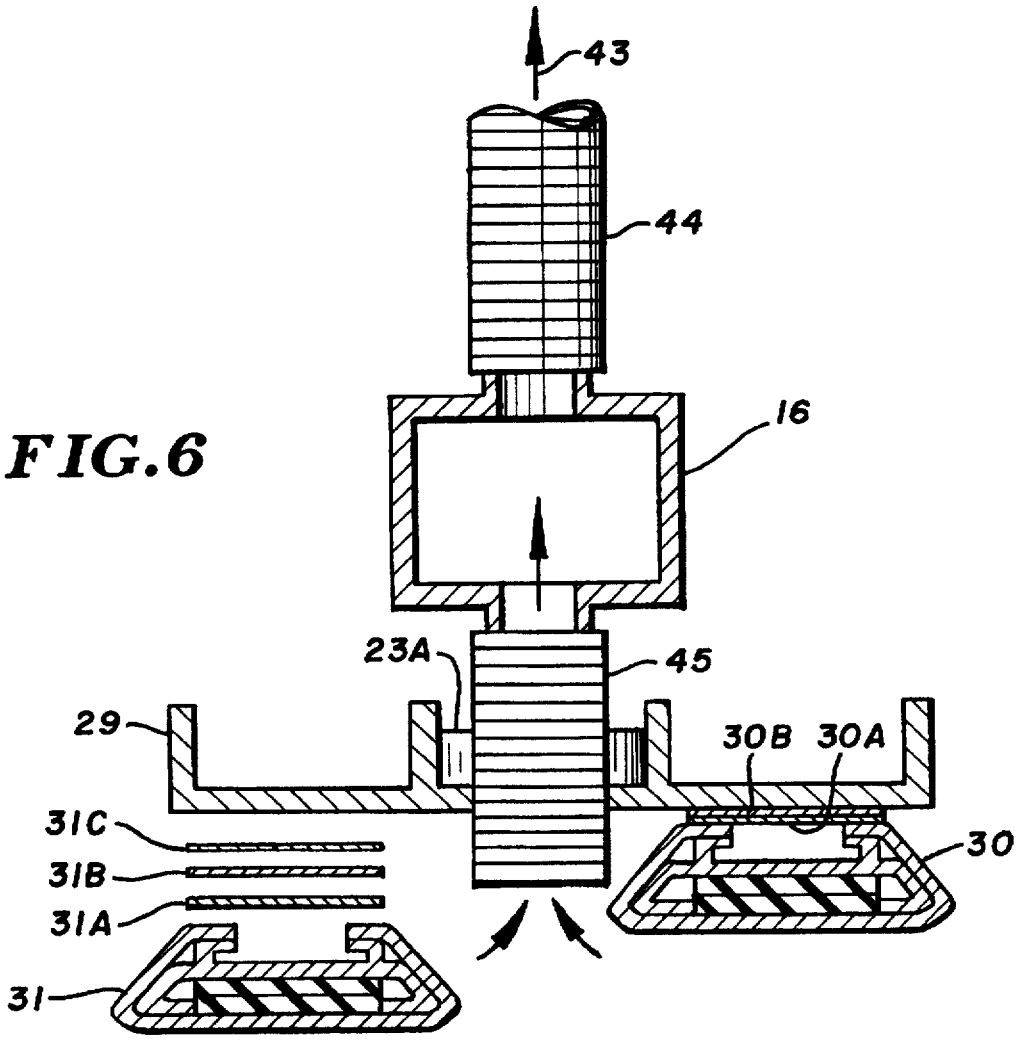
FIG. 6 is a view similar to FIG. 5, and further illustrating the details of the particulate removal system interposed between the twin platens, and including the showing, in partially exploded view, an arrangement for positioning shims to appropriately adjust the working height of the platen surface.
Figure 7:
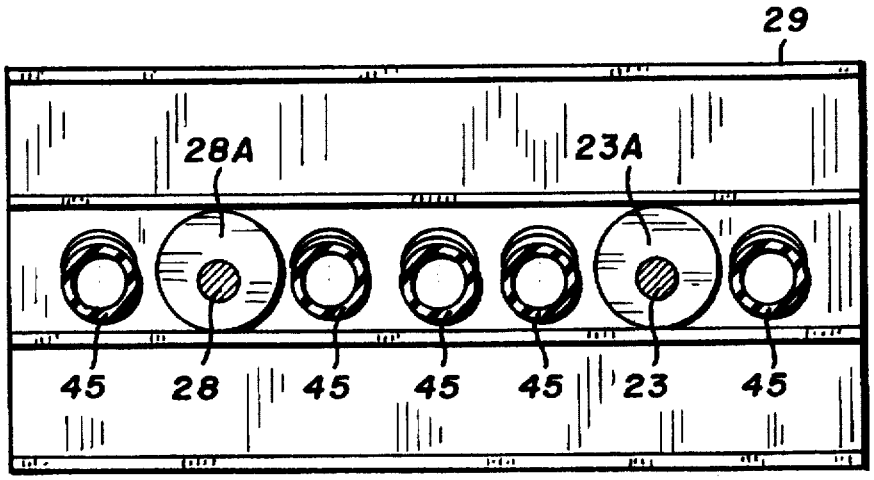
FIG. 7 is a top view of the carrier plate upon which the twin platens are mounted, with FIG. 7 further illustrating the disposition of the exhaust tubes which comprise a portion of the particulate removal system.

In the event the specific operation requires a difference in height and/or elevation of the individual platens 30 and 31, the shim arrangement illustrated in FIG. 6 is employed to position the downstream platen 31 slightly lower than upstream platen 30. Additionally, the availability of shims such as 30A, 30B, 31A, 31B, and 31C permit the operator to appropriately adjust the elevations of the platens to accommodate variations encountered as a result of machine wear and the like.

The preferred embodiment described hereinabove has been undertaken with respect to a twin platen or abrasive head or pad arrangement. The features of the present invention may be incorporated in alternate preferred embodiments wherein systems incorporating multiple abrasive heads or pads or platens are utilized, with these alternate embodiments including three or more platens. In such preferred embodiments, the abrasive heads or pads or platens will share a common drive, as described hereinabove, and will also include particulate removal means with inlet ports disposed in the gap zones created between mutually adjacent abrasive pads or platens.

It will be understood by those skilled in the art that various modifications may be made of the embodiments disclosed herein without departing from the spirit and scope of the present invention.

What is claimed is:

1. In combination, a sanding apparatus having a frame, a work conveyor with an endless belt having a work supporting flight for transporting workpieces thereupon from an infeed end to an outfeed end along an axis defining a machine direction, support means coupled to said frame for mounting an abrasive head with work surface treating means thereon for creating and defining a working zone along said work supporting flight, and a particulate removal means for removal of particulate from said working zone; said combination being characterized in that:

(a) said working zone comprises a platen mounting plate with means for mounting a pair of elongated abrasive heads on opposed sides thereof, a pair of generally parallelly disposed elongated abrasive heads mounted on said plate having their elongate axes disposed generally transversely of said machine direction axis and being arranged in spaced apart relationship along said machine direction axis with a gap zone defined between mutually opposed edge surfaces of said abrasive heads, said mounting plate having an opening formed therein and being disposed within said gap zone;

(b) said mounting plate along with said abrasive heads being coupled to motion generating means for simultaneous oscillatory motion of said heads;

(c) said particulate removal means comprising ductwork with an inlet port at one end, an outlet port at the other end, and with said inlet port passing through said mounting plate opening into close proximity with said work supporting flight, said ductwork extending from said inlet port to said outlet port for movement of a flow of air away from said inlet port, and including a flexible conduit to permit said inlet port to move with said mounting plate, said inlet port having a cross-sectional dimension substantially equal to the width of said gap zone and being positioned within said gap zone to move with said mounting plate for direct removal of particulate from that portion of the surface of the workpiece disposed therewithin, and said outlet port being in communication with a separator/collector means for separation of entrained particulate from said flow of air.

2. The combination as defined in claim 1 being particularly characterized in that means are provided for adjustably positioning each of said abrasive heads with respect to said abrasive head support means.

3. The combination as defined in claim 1 being particularly characterized in that each of said abrasive heads is coupled to motion generating means for simultaneous oscillatory and reciprocatory motion of said heads, and wherein said reciprocatory motion is transverse to the machine direction axis.

4. The combination as defined in claim 3 being particularly characterized in that said inlet port includes an inlet manifold means disposed within said ductwork.

5. The combination as defined in claim 4 wherein a plurality of laterally spaced apart inlet ports extend from said manifold to transversely spaced-apart positions within said gap zone, and wherein said plurality of inlet ports being aligned along an axis parallel to the axis of said reciprocatory motion.

6. The combination as defined in claim 1 being particularly characterized in that means are provided for adjustably positioning said motion generating means to preserve simultaneous oscillatory motion of said heads.

* * * * *